US007846033B2

(12) United States Patent
Kato et al.

(10) Patent No.: US 7,846,033 B2
(45) Date of Patent: Dec. 7, 2010

(54) IRON TYPE GOLF CLUB HEAD

(75) Inventors: Akira Kato, Kobe (JP); Kazuyoshi Takarada, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 12/335,131

(22) Filed: Dec. 15, 2008

(65) Prior Publication Data

US 2009/0221384 A1 Sep. 3, 2009

(30) Foreign Application Priority Data

Feb. 28, 2008 (JP) ..... 2008-047000

(51) Int. Cl.
*A63B 69/36* (2006.01)

(52) U.S. Cl. ..... 473/242; 473/331

(58) Field of Classification Search ..... 473/330–331, 473/219–256

See application file for complete search history.

(56) References Cited

U.S. PATENT DOCUMENTS

| | | | | | |
|---|---|---|---|---|---|
| 1,569,212 | A | * | 1/1926 | Abram | 473/242 |
| D83,700 | S | * | 3/1931 | Schmermund | D19/42 |
| 2,005,401 | A | * | 6/1935 | Storz | 473/331 |
| D96,478 | S | * | 8/1935 | Jansky | D21/750 |
| 2,520,950 | A | * | 9/1950 | Miller | 473/242 |
| D193,098 | S | * | 6/1962 | Davis | D21/750 |
| 4,077,632 | A | * | 3/1978 | Taylor | 473/242 |
| 4,128,242 | A | * | 12/1978 | Elkins, Jr. | 473/291 |
| 4,222,567 | A | * | 9/1980 | Shabala | 473/242 |
| 4,345,763 | A | * | 8/1982 | Swanson | 473/242 |
| 4,550,914 | A | * | 11/1985 | McCallister | 473/242 |
| 4,753,440 | A | * | 6/1988 | Chorne | 473/242 |
| 4,913,435 | A | * | 4/1990 | Kobayashi | 473/242 |
| D315,587 | S | * | 3/1991 | Antonious | D21/749 |
| D327,932 | S | * | 7/1992 | Stuff | D21/751 |
| 5,354,059 | A | * | 10/1994 | Stuff | 473/329 |
| D367,096 | S | * | 2/1996 | Louden et al. | D21/750 |
| D376,632 | S | * | 12/1996 | Simmons | D21/750 |
| 5,785,610 | A | * | 7/1998 | Birmingham | 473/331 |
| 6,309,310 | B1 | * | 10/2001 | Shira | 473/331 |
| 6,348,010 | B1 | * | 2/2002 | Doolen | 473/290 |
| D484,936 | S | * | 1/2004 | Fleck | D21/749 |
| D490,129 | S | * | 5/2004 | Greene | D21/748 |
| 2004/0116198 | A1 | * | 6/2004 | Schudel | 473/242 |

FOREIGN PATENT DOCUMENTS

JP 2007-307095 A 11/2007

* cited by examiner

*Primary Examiner*—Sebastiano Passaniti
(74) *Attorney, Agent, or Firm*—Birch, Stewart, Kolasch & Birch, LLP

(57) ABSTRACT

An iron type golf club head has a toe inclination visually recognizing part and a heel inclination visually recognizing part. The toe inclination visually recognizing part, which is provided on a toe side of a face surface, formed by a visible boundary between a toe side region of the face surface and a center region of the face surface, can be visually recognized to be inclined to a heel side from the toe side in a direction toward a sole side from a top side. The heel inclination visually recognizing part, which is formed on the heel side of the face surface, formed by a visible boundary between a heel side region of the face surface and a center region of the face surface, can be visually recognized to be inclined to the heel side from the toe side in a direction toward the sole side from the top side.

6 Claims, 5 Drawing Sheets

IRON TYPE GOLF CLUB HEAD

The present application claims priority to Japan Patent Application No. 2008-047000, filed Feb. 28, 2008, incorporated herein by reference in its entirety.

BACKGROUND OF THE INVENTION

1. Field of the Invention

The present invention relates to an iron type golf club head.

2. Description of the Related Art

An iron type golf club may be addressed with a face opened. When the face is opened, a loft angle (effective loft angle) with respect to a vertical line increases. When a golf ball is hit by the golf club with the face opened, high trajectory is easily obtained. When the golf ball is hit high, the face is opened.

Japanese Patent Application Laid-Open Publication No. 2007-307095 discloses an iron type golf club head having first score lines and second score lines extending so as to be inclined downward to a front side with respect to the first score lines. The second score lines are provided above the first score lines. The second score lines are provided as a reference line for addressing with the face opened.

SUMMARY OF THE INVENTION

The present inventor examined the shot made with the face opened. As a result, the present invention was attained based on technical idea different from the conventional one. The present invention found that influence to the hit golf ball in the shot made with the face opened, particularly a backspin speed of the golf ball can be improved. Furthermore, the present invention found that an effect of improving a swing of the golf club in the shot made with the face opened can be obtained.

It is an object of the present invention to provide an iron type golf club head capable of improving a shot made with a face opened.

An iron type golf club head according to the present invention has a face surface including a toe inclination visually recognizing part and a heel inclination visually recognizing part. The toe inclination visually recognizing part, which is formed on a toe side of the face surface, can be visually recognized to be inclined to a heel side from the toe side as going to a sole side from a top side. The heel inclination visually recognizing part, which is formed on the heel side of the face surface, can be visually recognized to be inclined to the heel side from the toe side as going to the sole side from the top side. An inclination angle $\alpha$1 of the toe inclination visually recognizing part with respect to a vertical direction reference line is no less than 5 degrees and no more than 15 degrees. An inclination angle $\alpha$2 of the heel inclination visually recognizing part with respect to the vertical direction reference line is no less than 5 degrees and no more than 15 degrees. A real loft angle B of this head is no less than 50 degrees and no more than 70 degrees.

A face line is preferably provided on the face surface. The face line is preferably inclined to the top side from the sole side as going to the heel side from the toe side. An inclination angle $\beta$ of the face line with respect to a horizontal direction reference line is preferably no less than 5 degrees and no more than 15 degrees.

A ratio ($B/\beta$) of the real loft angle B to the inclination angle $\beta$ is preferably no less than 5 and no more than 10.

Preferably, a plurality of face lines are provided on the face surface, and a plurality of longest face lines of the face lines exist. The toe inclination visually recognizing part is preferably formed by arrangement of toe side ends of the plurality of longest face lines. The heel inclination visually recognizing part is preferably formed by arrangement of heel side ends of the plurality of longest face lines.

The present invention can improve the swing in the shot made with the face opened. The present invention can improve backspin performance in the shot made with the face opened.

DESCRIPTION OF THE PREFERRED EMBODIMENTS

Hereinafter, the present invention will be described in detail based on a preferred embodiment with reference to the appropriate drawings.

The definitions of terms according to the present invention will be described later prior to the description of this embodiment. In the following definitions, numerals used in the embodiment described later will be appropriately used.

[Reference State]

A reference state of a head 2 means a state where the head 2 is placed on a level surface h at a predetermined lie angle La and a real loft angle B. In detail, the reference state of the head 2 means a state where the head 2 is ground on the level surface h with a central axis line z of a shaft hole of the head 2 arranged in an optional vertical plane VP1, the central axis line z tilted at the lie angle La to the level surface h, a face surface 4 tilted at the real loft angle B to the vertical plane VP1 (see FIGS. 1, and 2). The vertical plane VP1 is a plane which is parallel to a vertical line.

[Sweet Spot SS]

Figure 1:
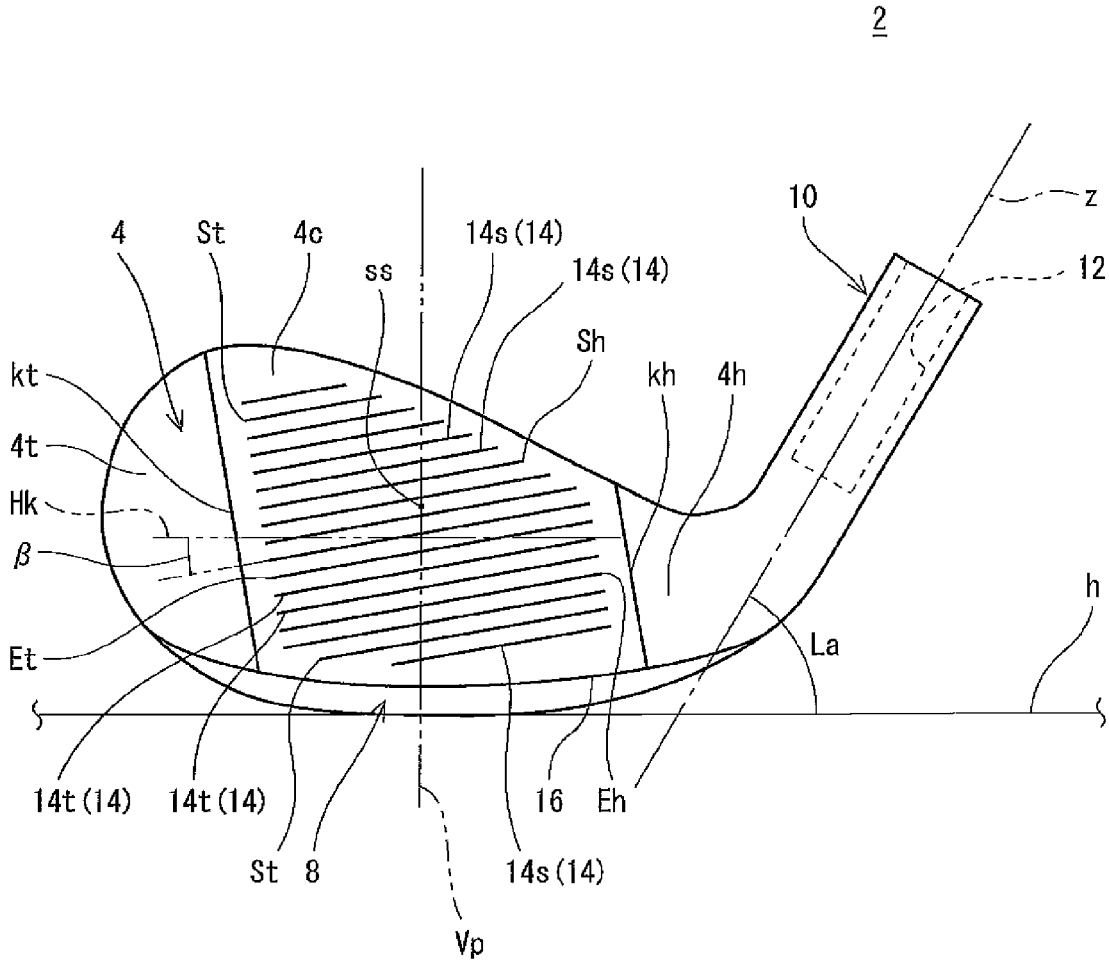
FIG. 1 shows an iron type golf club head according to an embodiment of the present invention as viewed from the front.

An intersection point of a perpendicular line V1 (not shown) and a face surface 4 is a sweet spot SS, the perpendicular line V1 drawn to the face surface 4 from a centroid of the head 2 (see FIG. 1).

[Reference Vertical Plane Vp]

Figure 2:
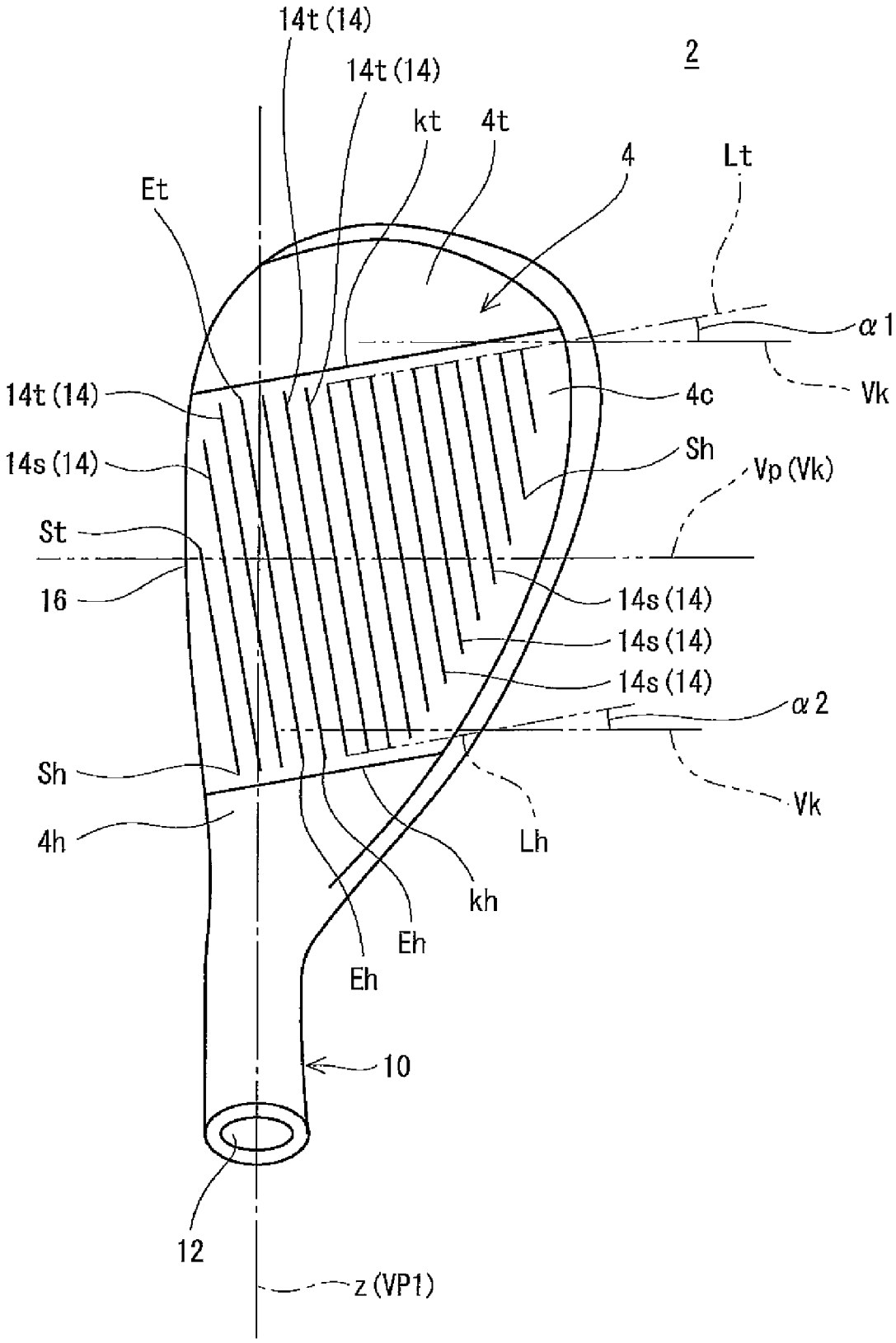
FIG. 2 shows the iron type golf club head of FIG. 1 as viewed from the above.

In the head 2 having the reference state, a plane which includes the perpendicular line V1 and is perpendicular to the level surface h is a reference vertical plane Vp (see FIGS. 1, 2).

[Face-Back Direction]

In the head 2 having the reference state, a direction along an intersection line K1 (not shown) of the level surface h and reference vertical plane Vp is defined as a face-back direction.

[Toe-Heel Direction]

In the head 2 having the reference state, a direction which is perpendicular to the intersection line K1 and parallel to the level surface h is defined as a toe-heel direction. A "toe side" and a "heel side" in the present application are determined based on the toe-heel direction.

[Top-Sole Direction]

A direction along an intersection line K2 (not shown) of the reference vertical plane Vp and the face surface 4 is defined as a top-sole direction. A "top side and a "sole side" in the present application are determined based on the top-sole direction. When the face surface 4 is a curved surface, a tangent line SL (not shown) in the sweet spot SS of the intersection line K2 is defined. When the face surface 4 is a curved surface, a direction along the tangent line SL is defined as the top-sole direction.

[Vertical Direction Reference Line]

A straight line which is parallel to the top-sole direction is defined as a vertical direction reference line.

[Horizontal Direction Reference Line]

A straight line which is parallel to the toe-heel direction is defined as a horizontal direction reference line.

Next, an embodiment of the present invention will be described.

Figure 3:
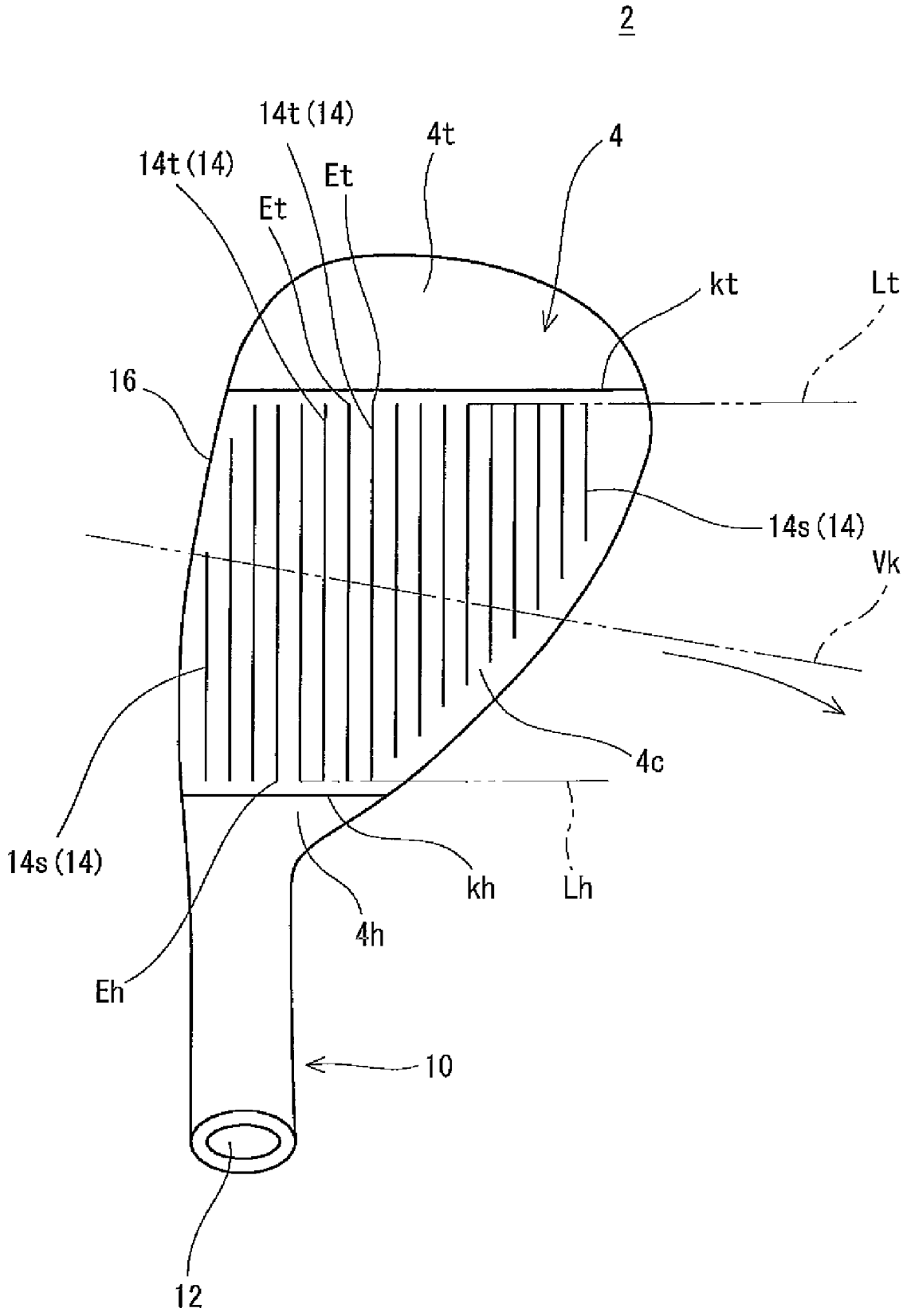
FIG. 3 shows the iron type golf club head of FIG. 1 with the face opened as viewed from the above.
Figure 4:
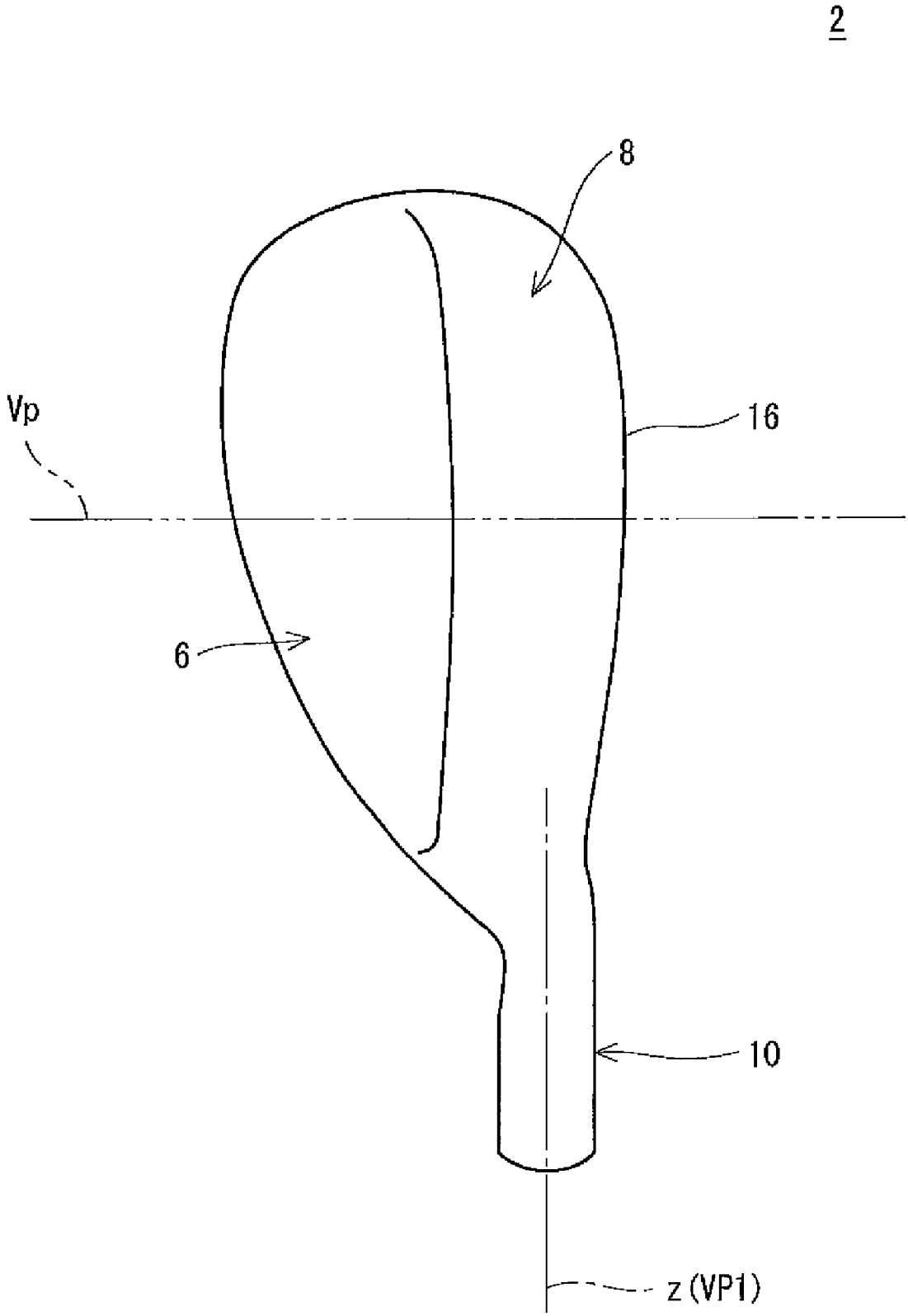
FIG. 4 shows the iron type golf club head of FIG. 1 as viewed from a sole surface side.
Figure 5:
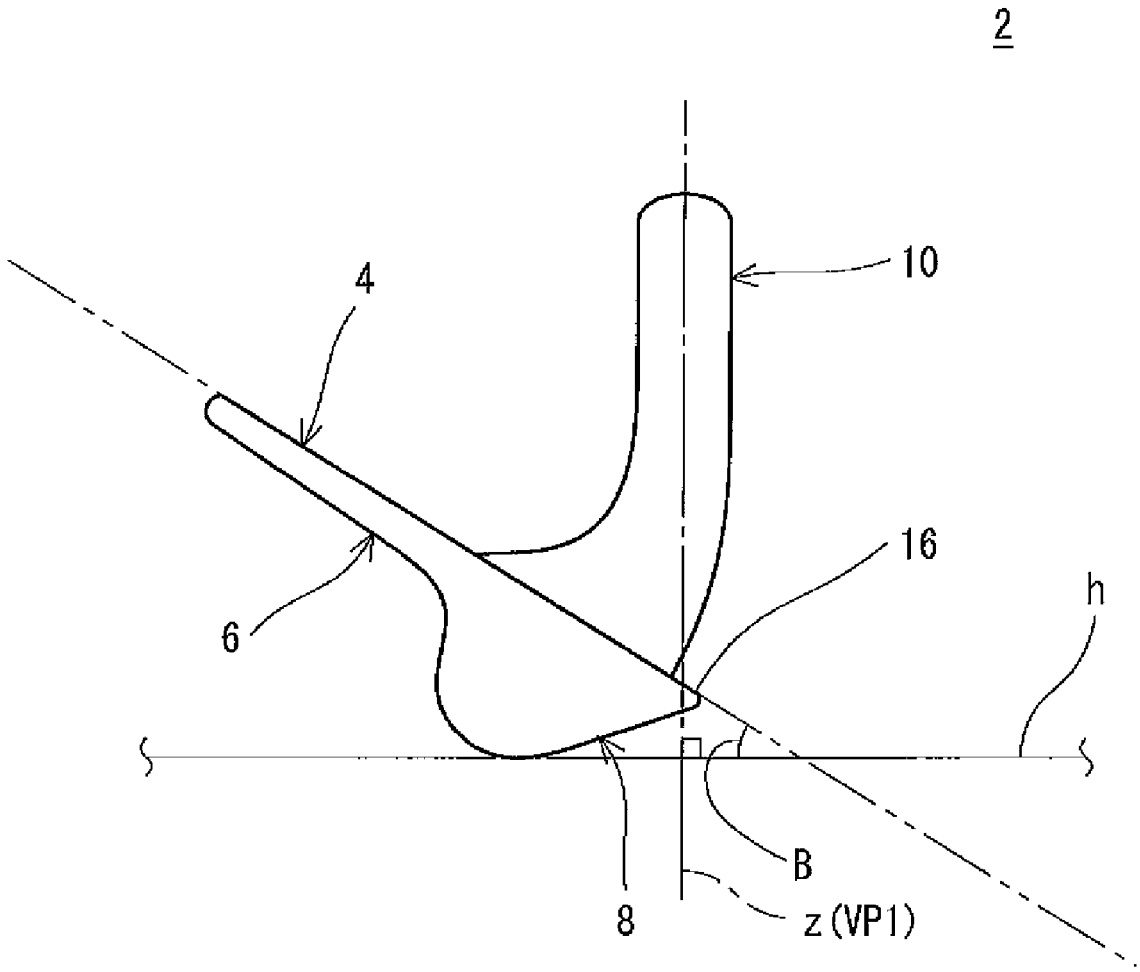
FIG. 5 is a side view of the iron type golf club head of FIG. 1 as viewed from a toe side.

FIG. 1 is a front view of an iron type golf club head 2 according to an embodiment of the present invention. FIG. 1 shows a reference state of the iron type golf club head 2 placed on a level surface h. FIG. 2 shows the head 2 in the reference state as viewed from the above. FIG. 3 shows the head 2 with the face opened as viewed from the above. FIG. 4 shows the head 2 as viewed from a sole surface side. FIG. 5 is a side view of the head 2 as viewed from a toe side. FIG. 5 shows the reference state of the head 2 placed on the level surface h.

The head 2 has a face surface 4, a back face 6 and a sole surface 8. The head 2 has a hosel 10. The hosel 10 has a shaft hole 12. The face surface 4 has face lines 14 provided thereon. The face lines 14 have a groove shape. The face lines 14 can increase a backspin speed of a golf ball. The face surface 4 has a lower edge constituting a leading edge 16.

The face surface 4 has a center region 4*c*, a toe side region 4*t* and a heel side region 4*h*. The face surface 4 has a toe side boundary line kt and a heel side boundary line kh. The center region 4*c* is located between the toe side boundary line kt and the heel side boundary line kh. The center region 4*c* and the toe side region 4*t* are partitioned by the toe side boundary line kt. The center region 4*c* and the heel side region 4*h* are partitioned by the heel side boundary line kh. The toe side boundary line kt is a straight line. The heel side boundary line kh is a straight line. The toe side boundary line kt and the heel side boundary line kh are parallel with each other.

The center region 4*c* has an appearance different from that of the toe side region 4*t*. This difference in appearance results from the difference in surface treatments. That is, the surface treatment of the center region 4*c* is different from that of the toe side region 4*t*. The toe side boundary line kt capable of being visually recognized results from this difference in the appearance.

The center region 4*c* is subjected to sand blasting. On the other hand, the toe side region 4*t* is not subjected to the sand blasting. The center region 4*c* has surface roughness different from that of the toe side region 4*t*. The difference in the appearances of the center region 4*c* and toe side region 4*t* results from this difference in the surface roughness.

The center region 4*c* has an appearance different from that of the heel side region 4*h*. This difference in appearance results from the difference in surface treatments. That is, the surface treatment of the center region 4*c* is different from that of the heel side region 4*h*. The heel side boundary line kh capable of being visually recognized results from this difference in the appearance.

The heel side region 4*h* is not subjected to the sandblasting. The center region 4*c* has surface roughness different from that of the heel side region 4*h*. The difference in the appearances of the center region 4*c* and heel side region 4*h* result from this difference in the surface roughness.

All of the face lines 14 are provided in the center region 4*c*. The center region 4*c* has a surface which is roughened by the sand blasting and in which the face lines 14 are provided. Therefore, a hitting point in the center region 4*c* easily increases the backspin speed.

The plurality of face lines 14 is provided. The face lines 14 are formed at constant intervals. All of the face lines 14 linearly extend. All of the face lines 14 are parallel with each other.

The longest face lines 14 of the plurality of face lines 14 are the longest face lines 14*t*. The head 2 has the longest face lines 14*t* and short face lines 14*s* shorter than the longest face lines 14*t*. The plurality of longest face lines 14*t* is provided. In this embodiment, the number of the longest face lines 14*t* is six. When all of the face lines have the same length in another embodiment, all of the face lines are the longest face lines.

Since the plurality of longest face lines 14*t* exists, a plurality of toe side ends Et of the longest face lines 14*t* also exists. All of the ends Et are substantially on the same straight line. That is, these ends Et are arranged on a straight line Lt (see FIG. 2). This straight line Lt is substantially parallel to the toe side boundary line kt. Toe side ends St of the short face lines 14*s* are located on the straight line Lt, or are located on the heel side relative to the straight line Lt.

Since the plurality of longest face lines 14*t* exists, and a plurality of heel side ends Eh of the longest face lines 14*t* also exists. All of the ends Eh are substantially on the same straight line. That is, these ends Eh are arranged on a straight line Lh (see FIG. 2). This straight line Lh is substantially parallel to the heel side boundary line kh. Heel side ends Sh of the short face lines 14*s* are located on the straight line Lh, or are located on the toe side relative to the straight line Lh.

The face surface 4 has a toe inclination visually recognizing part. The position of the toe inclination visually recognizing part may be on the toe side relative to a heel inclination visually recognizing part. In this embodiment, the toe inclination visually recognizing part is formed by the arrangement of the plurality of the ends Et. The plurality of ends Et is on the straight line Lt. Therefore, the plurality of ends Et can be visually recognized to be inclined to the heel side from the toe side as going to the sole side from the top side. The straight line Lt itself is not drawn on the face surface 4. However, the toe inclination visually recognizing part is formed by the arrangement of the plurality of ends Et.

This embodiment has the toe side boundary line kt as still another toe inclination visually recognizing part. The number of the toe inclination visually recognizing parts may be one. For example, the toe side boundary line kt may not exist, and only the toe inclination visually recognizing part may be formed by the arrangement of the toe side ends Et. The toe inclination visually recognizing part formed by the arrangement of the toe side ends Et may not exist, and the toe side boundary line kt may exist as only the toe inclination visually recognizing part. In this embodiment, two toe inclination visually recognizing parts are provided, and these are parallel with each other. Thereby, the visual effect of the toe inclination visually recognizing part is enhanced.

The face surface 4 has the heel inclination visually recognizing part. The position of the heel inclination visually recognizing part may be on the heel side relative to the toe inclination visually recognizing part. In this embodiment, the heel inclination visually recognizing part is formed by the arrangement of the plurality of ends Eh. The plurality of ends Eh is on the straight line Lh. Therefore, the plurality of ends Eh can be visually recognized to be inclined to the heel side from the toe side as going to the sole side from the top side. The straight line Lh itself is not drawn on the face surface 4.

However, the heel inclination visually recognizing part is formed by the arrangement of the plurality of ends Eh.

This embodiment has the heel side boundary line kh as still another heel inclination visually recognizing part. The number of the heel inclination visually recognizing parts may be one. For example, the heel side boundary line kh may not exist, and only the heel inclination visually recognizing part may be formed by the arrangement of the heel side ends Eh. The heel inclination visually recognizing part formed by the arrangement of the heel side ends Eh may not exist, and the heel side boundary line kh may exist as only the heel inclination visually recognizing part. In this embodiment, two heel inclination visually recognizing parts are provided, and these are parallel with each other. Thereby, the visual effect of the heel inclination visually recognizing part is enhanced.

The toe inclination visually recognizing part and the heel inclination visually recognizing part can have an effect for stabilizing the backspin speed (backspin stabilizing effect) The toe inclination visually recognizing part and the heel inclination visually recognizing part can have an effect for increasing the backspin speed (backspin increasing effect). Furthermore, the toe inclination visually recognizing part and the heel inclination visually recognizing part can have a swing improving effect for visually improving a swing.

The hitting points are easily distributed over a region from a central part in the toe-heel direction near the sole to a portion near the top and the toe in a shot made with the face opened. This distribution of the hitting points results from the head track of the shot made with the face opened. In the conventional head, a region having no face line is easily produced in the portion near the top and the toe. Therefore, the conventional head has comparatively high probability that the hitting points exist in the region having no face line. The conventional head easily intermingles a case where the hitting points exist in the region having no face line with a case where the hitting points exist in the region having the face lines. Therefore, the conventional head easily destabilizes the backspin speed. On the other hand, this embodiment hardly produces the region having no face line in the portion near the top and the toe. The head of this embodiment hardly intermingles the case where the hitting points exist in the region having no face line with the case where the hitting points exist in the region having the face lines. Therefore, the head of this embodiment easily stabilizes the backspin speed.

The backspin speed easily increases as the angle of each of the face lines to the track of the head gets closer to a right angle. The face lines 14 of this embodiment are inclined in the above-described direction with respect to a horizontal direction reference line Hk. Thus, the angle of each of the face lines 14 to the head track of the shot made with the face opened easily gets closer to a right angle. Therefore, the backspin speed easily increases with the head of this embodiment.

In the conventional head, the face lines extend in a direction nearly parallel to the horizontal direction reference line Hk. In the conventional head, the ends of the face lines are arranged along a straight line nearly parallel to a vertical direction reference line Vk. Therefore, with the conventional head, take-back is easily performed in a direction along the vertical direction reference line Vk. That is, the take-back to an inside is easily performed in the shot made with the face opened with the conventional head (see an arrow of FIG. 3). In the shot made with the face opened, the take-back to the inside easily causes a mis-shot. A cause of this mis-shot is reduction in the incidence angle (downward blow angle) of the head track to the ground due to the take-back to the inside. In this embodiment, the take-back to the inside is hardly performed thanks to the visual effects of the toe inclination visually recognizing part and heel inclination visually recognizing part. That is, the head of this embodiment can have the swing improving effect for visually improving the swing.

FIG. 2 shows the inclination angle $\alpha 1$ of the toe inclination visually recognizing part and the inclination angle $\alpha 2$ of the heel inclination visually recognizing part.

In this embodiment, the inclination angle $\alpha 1$ of the toe inclination visually recognizing part is an angle formed between the straight line Lt and the vertical direction reference line Vk. While not shown in FIG. 2, the inclination angle $\alpha 1$ of the toe inclination visually recognizing part is also an angle formed between the straight line Lt and the toe side boundary line kt.

In this embodiment, the inclination angle $\alpha 2$ of the heel inclination visually recognizing part is an angle formed between the straight line Lh and the vertical direction reference line Vk. While not shown in FIG. 2, the inclination angle $\alpha 2$ of the heel inclination visually recognizing part is also an angle formed between the straight line Lh and the heel side boundary line kh.

From the viewpoint of enhancing the backspin stabilizing effect and the swing improving effect, the inclination angle $\alpha 1$ of the toe inclination visually recognizing part is preferably 5 degrees or more, and more preferably 6 degrees or more. When the inclination angle $\alpha 1$ is too large, visual sense of discomfort is easily produced in the shot made with the face not opened. This sense of discomfort may have bad influence on the swing. From this viewpoint, the inclination angle $\alpha 1$ is preferably 15 degrees or less, and more preferably 12 degrees or less.

From the viewpoint of enhancing the backspin stabilizing effect and the swing improving effect, the inclination angle $\alpha 2$ of the heel inclination visually recognizing part is preferably 5 degrees or more, and more preferably 6 degrees or more. When the inclination angle $\alpha 2$ is too large, visual sense of discomfort is easily produced in the shot made with the face not opened. This sense of discomfort may have bad influence on the swing. From this, viewpoint, the inclination angle $\alpha 2$ is preferably 15 degrees or less, and more preferably 12 degrees or less.

From the viewpoint of obtaining the synergic effects of an effect caused by the inclination angle $\alpha 1$ and effect caused by the inclination angle $\alpha 2$, the inclination angle $\alpha 1$ and the inclination angle $\alpha 2$ are preferably the same.

The present invention has high effectiveness in the shot made with the face opened. From this viewpoint, the real loft angle B is preferably 50 degrees or more, and more preferably 52 degrees or more. From the viewpoint of the practicality, the real loft angle B, is preferably 70 degrees or less.

From the viewpoint of enhancing the backspin increasing effect and the swing improving effect, the inclination angle $\beta$ of each of the face lines is preferably 5 degrees or more, and more preferably 6 degrees or more. When the inclination angle $\beta$ is too large, the backspin speed is easily reduced in the shot made with the face not opened. When the inclination angle $\beta$ is too large, visual sense of discomfort is easily produced in the shot made with the face not opened. This sense of discomfort may have bad influence on the swing. From these viewpoints, the inclination angle $\beta$ of each of the face lines is preferably 15 degrees or less, and more preferably 12 degrees or less.

From the viewpoint of enhancing the effect resulting from the inclination angle $\beta$, each of the inclination angles $\beta$ of all of the face lines is preferably set to the preferred range described above. From the viewpoint of enhancing the effect resulting from the inclination angle $\beta$, the inclination angles $\beta$ of all of the face lines are preferably the same.

As described above, the hitting points are easily distributed over the region from the central part in the toe-heel direction near the sole to the portion near the top and the toe in the shot made with the face opened. Such distribution of the hitting points usually tends to be remarkable as the real loft angle B is larger. From this viewpoint, the inclination angle β of each of the face lines is preferably larger as the real loft angle B is larger. From this viewpoint, a ratio (B/β) of the real loft angle B (degrees) to the inclination angle β (degrees) is preferably within a constant range. From the viewpoints of enhancing the backspin speed in the shot made with the face not opened and of suppressing the visual sense of discomfort, the ratio (B/β) is preferably 5 or more, and more preferably 6 or more. From the viewpoint of enhancing the backspin increasing effect and the swing improving effect which are described above, the ratio (B/β) is preferably 10 or less, and more preferably 9 or less.

The toe inclination visually recognizing part is not limited to one shown in the embodiment. As shown in the embodiment, the toe inclination visually recognizing part may be formed by the arrangement of the ends of the face lines, or may be formed by the arrangement of punch marks. Naturally, the toe inclination visually recognizing part may be formed by lines such as a straight line.

The heel inclination visually recognizing part is not limited to one shown in the embodiment. As shown in the embodiment, the heel inclination visually recognizing part may be formed by the arrangement of the ends of the face lines, or may be formed by the arrangement of punch marks. Naturally, the heel inclination visually recognizing part may be formed by lines such as a straight line.

The toe side boundary line kt as the toe inclination visually recognizing part, which is not limited to the constitution described above, may be capable of being visually recognized. As shown in the embodiment, the toe side boundary line kt, which may be formed by the difference in the surface roughness, may be formed by, for example, a boundary line formed by coating, plating or an oxide layer. This coating boundary line may be a boundary line formed, for example, by the absence or presence of the coating, or may be a boundary line having a coating color. This plating boundary line may be a boundary line having a plating color, or may be a boundary line formed by the absence or presence of the plating. The oxide layer boundary line may be a boundary line formed by the absence or presence of the oxide layer, or may be a boundary line having a color of the oxide layer.

The heel side boundary line kh as the heel inclination visually recognizing part, which is not limited to the constitution described above, may be capable of being visually recognized. As shown in the embodiment, the heel side boundary line kh, which may be formed by the difference in the surface roughness, may be formed by, for example, a boundary line formed by coating, plating or an oxide layer. This coating boundary line may be a boundary line formed, for example, by the absence or presence of the coating, or may be a boundary line having a coating color. This plating boundary line may be a boundary line having a plating color, or may be a boundary line formed by the absence or presence of the plating. The oxide layer boundary line may be a boundary line formed by the absence or presence of the oxide layer, or may be a boundary line having a color of the oxide layer.

The toe side boundary line kt and/or the heel side boundary line kh may be formed by the difference in materials of the face surface. For example, the head may have the center region 4*c* formed by a plate-shaped insert member prepared using a material different from that of a head main body. This insert member, which is attached to the face surface 4, has a contour shape formed in a shape corresponding to the center region 4*c*. In this case, the toe side boundary line kt and the heel side boundary line kh are formed by the contour line of the insert member.

As described above, the toe inclination visually recognizing part and the heel inclination visually recognizing part (hereinafter, collectively referred to as inclination visually recognizing parts) include the following constitution A and constitution B.

(Constitution A) The inclination visually recognizing parts formed by the arrangement of the ends of the face lines or punch marks or the like (Constitution B) The inclination visually recognizing parts formed by the lines The constitution B includes the toe side boundary line kt or the heel side boundary line kh. As described above, the toe side boundary line kt and the heel side boundary line kh have various aspects. Furthermore, the constitution B includes a straight line formed by a groove or the like, and a straight line drawn by the coating or the like.

From the viewpoints of production cost and visual effect, a constitution A1 of the constitution A is preferable. This constitution A1 is adopted in the embodiment.

(Constitution A1) The inclination visually recognizing parts formed by the arrangement of the ends Et, Eh of the face lines From the viewpoints of production cost and visual effect, a constitution B1 of the constitution B is preferable. This constitution B1 is adopted in the embodiment.

(Constitution B1) The inclination visually recognizing parts formed by the toe side boundary line kt and the heel side boundary line kh; the toe side boundary line kt is formed by making the surface roughness of the center region 4*c* and toe side region 4*t* different; and the heel side boundary line kh is formed by making the surface roughness of the center region 4*c* and heel side region 4*h* different From the viewpoints of production cost and visual effect, the constitution A1 and the constitution B1 are particularly preferably used together.

The material of the head is not limited. Examples of the materials of the head include metal, a fiber reinforced resin and the like. Examples of the metals include soft iron (soft steel), stainless steel, maraging steel, pure titanium, a titanium alloy and an aluminum alloy. The head main body is preferably made of metal in the head made of two kinds or more of materials. It is preferable that all of the materials of the head are integrally made of metal when the toe side boundary line kt and the heel side boundary line kh are formed by the difference in the surface roughness as shown in the above embodiment. In this case, both the productivity and the strength can be realized.

From the viewpoint of enlarging the setting region of the face lines to enhance the backspin stability, the length of each of the longest face lines 14*t* is preferably 40 mm or more, and more preferably 50 mm or more. When the toe side ends Et excessively come near to the toe side, the width of the face surface 4 in the top-sole direction is narrowed, and the arrangement number of the toe side ends Et is easily constrained. When the heel side ends Eh excessively come near to the heel side, the width of the face surface 4 in the top-sole direction is narrowed, and the arrangement number of the heel side ends Eh is easily constrained. When the arrangement number of the toe side ends Et is small, the visual effect of the toe inclination visually recognizing part formed by the arrangement of these ends Et is easily declined. Similarly, when the arrangement number of the heel side ends Eh is small, the visual effect of the heel inclination visually recognizing part formed by the arrangement of these ends Eh is easily declined. From these viewpoints, the length of each of the longest face lines 14*t* is preferably 80 mm or less, more preferably 70 mm or less, and still more preferably 60 mm or less.

From the viewpoint of increasing the arrangement number of the toe side ends Et and the arrangement number of the heel side ends Eh, the number of the longest face lines 14*t* is preferably 3 or more, more preferably 5 or more, still more preferably 6 or more, and particularly preferably 7 or more. From the constraint caused by the size of the face surface 4, the number of the longest face lines 14*t* is preferably 12 or less, and more preferably 11 or less.

From the viewpoint of enhancing the visual effects of the inclination visually recognizing parts formed by the arrangements of the ends Et, Eh of the longest face lines 14*t*, it is preferable that the short face lines Ids sandwiched between the longest face lines 14*t* do not exist.

From the viewpoint of enhancing the visual effect of the heel inclination visually recognizing part formed by the arrangement of the heel side ends Eh of the longest face lines 14*t*, when the short face lines 14*s* exist being located on the sole side relative to the longest face lines 14*t*, all of the heel side ends Sh thereof are preferably located on the straight line Lh.

From the viewpoint of enhancing the visual effect of the toe inclination visually recognizing part formed by the arrangement of the toe side ends Et of the longest face lines 14*t*, when the short face lines 14*s* exist being located on the top side relative to the longest face lines 14*t*, all of the toe side ends St thereof are preferably located on the straight line Lt.

From the viewpoint of enhancing the visual effect caused by the toe side boundary line kt, the length of the toe side boundary line kt is preferably 50 mm or more, and more preferably 55 mm or more. In view of the size of the face surface 4, the length of the toe side boundary line kt is usually preferably 70 mm or less, and more preferably 65 mm or less.

From the viewpoint of enhancing the visual effect caused by the heel side boundary line kh, the length of the heel side boundary line kh is preferably 25 mm or more, and more preferably 30 mm or more. In view of the size of the face surface 4, the length of the heel side boundary line kh is usually preferably 50 mm or less, and more preferably 45 mm or less.

EXAMPLES

Hereinafter, the effects of the present invention will be clarified by examples. However, the present invention should not be interpreted in a limited way based on the description of examples.

Example 1

The same head as a head 2 shown in FIG. 1 or the like was produced. Soft iron (S25C) was forged, and face lines were incused. The entire part of the head was subjected to surface polishing and plating. Next, a center region 4*c* was formed by sand blasting. The sand blasting number was #100. The center region 4*c* was subjected to the sand blasting while a toe side region 4*t* and a heel side region 4*h* were masked. A portion which was not masked was subjected to the sand blasting. A paper tape was used for the masking. A toe side boundary line kt and a heel side boundary line kh were correctly formed by the masking. Thus, an iron type golf club head according to example 1 was obtained. A real loft angle B was set to 60 degrees and a head weight was set to 300 g. A steel shaft was attached to the head, and a grip was further attached to the steel shaft to obtain an iron type golf club according to example 1. As the shaft, trade name "Dynamic Gold S400" produced by True Temper Sports Corporation was used. As the grip, trade name "Tour Velvet" (no code and no back line) produced by Eaton Corporation was used. The length of the club was set to 35 inches. The following Table 1 shows the specifications and evaluation results of example 1. An angle $\alpha$1 and angle $\alpha$2 shown in Table 1, which are angles of the straight line Lt and straight line Lh, are also angles of the heel side boundary line kh and toe side boundary line kt.

Examples 2 to 7 and Comparative Examples 1 to 3

Golf clubs according to examples 2 to 7 and comparative examples 1 to 3 were obtained in the same manner as in example 1 except that the specifications of heads were determined as shown in the following Table 1. The following Table 1 shows the specifications and evaluation results of each of examples.

The angle $\alpha$1, the angle $\alpha$2 and the angle $\beta$ were easily set by changing the incuse direction of face lines and the arrangement of masking.

[Evaluation Method]

Ten professional golf players evaluated the golf clubs with respect to three items.

[Evaluation 1] Evaluation by Standard Shot on Lawn Grass

The professional golf players targeted at a pin in 30 yards away and hit balls placed on lawn grass without opening faces of the clubs. As the ball, trade name "SRIXON Z-UR" produced by SRI Sports Limited was used. Each of the golf players hit five balls using each of the clubs. The backspin speeds of all golf balls right after being hit were measured. The following Table 1 shows the average value of the backspin speeds of all of the hit golf balls. Each of the golf players performed ten stages of sensory evaluations according to ten-point method with respect to "distance sense". Each of the golf players applied 10 to a golf club capable of easily controlling a distance and most highly evaluated, and applied a higher evaluated score of 1 to 10 to a golf club more highly evaluated. Each of the golf players applied a lower evaluated score to a golf club more hardly controlling the distance. This distance sense means the evaluation determined by each of the golf players on the basis of the last stopping point of the golf ball. The following Table 1 shows the average score (the average score is rounded to unit) of the evaluated scores of ten golf players.

[Evaluation 2] Evaluation by Lob Shot on Lawn Grass

The professional golf players targeted at a pin in 10 yards away and hit balls placed on lawn grass with faces opened. As the ball, trade name "SRIXON Z-UR" produced by SRI Sports Limited was used. Each of the golf players hit five balls using each of the clubs. The backspin speeds of all golf balls right after being hit were measured. The following Table 1 shows the average value of the backspin speeds of all of the hit golf balls. Each of the golf players performed ten stages of sensory evaluations according to ten-point method with respect to "distance sense". Each of the golf players applied 10 to a golf club capable of easily controlling a distance and most highly evaluated, and applied a higher evaluated score of 1 to 10 to a golf club more highly evaluated. Each of the golf players applied a lower evaluated score to a golf club more hardly controlling the distance. This distance sense means the evaluation determined by each of the golf players on the basis of the last stopping point of the golf ball. The following Table 1 shows the average score (the average score is rounded to unit) of the evaluated scores of ten golf players.

[Evaluation 3] Visual Sense of Discomfort

Each of the golf players performed five stages of sensory evaluations according to five-point method with respect to visual sense of discomfort. Each of the golf players applied 5 to a golf club most highly evaluated (having no sense of discomfort), and applied a higher evaluated score of 1 to 5 to a golf club more highly evaluated. The following Table 1 shows the average score (the evaluated scores are rounded to unit) of the evaluated scores of ten golf players.

TABLE 1

Specifications and Evaluation Results of Examples and Comparative Examples

| | | Examples | | | | | | | Comparative Examples | | |
|---|---|---|---|---|---|---|---|---|---|---|---|
| | | 1 | 2 | 3 | 4 | 5 | 6 | 7 | 1 | 2 | 3 |
| Loft Angle B (degrees) | | 60 | 60 | 60 | 60 | 60 | 60 | 60 | 60 | 60 | 60 |
| Angle α1 (degrees) | | 10 | 10 | 10 | 10 | 10 | 5 | 15 | 0 | 2 | 20 |
| Angle α2 (degrees) | | 10 | 10 | 10 | 10 | 10 | 5 | 15 | 0 | 2 | 20 |
| Angle β (degrees) | | 5 | 6 | 10 | 12 | 15 | 10 | 10 | 0 | 10 | 10 |
| B/β | | 12.0 | 10.0 | 6.0 | 5.0 | 4.0 | 6.0 | 6.0 | 0.0 | 6.0 | 6.0 |
| Standard Shot on Lawn Grass | Backspin Speed (rpm) | 5900 | 6020 | 5920 | 5850 | 5530 | 5890 | 5800 | 5720 | 5840 | 5060 |
| | Distance Sense | 7 | 8 | 7 | 6 | 4 | 7 | 5 | 5 | 6 | 3 |
| Lob Shot on Lawn Grass | Backspin Speed (rpm) | 7980 | 8150 | 8500 | 8630 | 8600 | 8460 | 8520 | 7080 | 7450 | 8520 |
| | Distance Sense | 6 | 7 | 9 | 8 | 7 | 8 | 8 | 5 | 6 | 8 |
| Visual Sense of Discomfort | | 5 | 5 | 4 | 4 | 3 | 5 | 4 | 5 | 4 | 2 |

As shown in Table 1, examples are highly evaluated as compared with comparative examples. From the evaluation results, the advantages of the present invention are apparent.

The present invention can be attached to the iron type golf club head.

The above description is only illustrative, and various changes can be made without departing from the scope of the present invention.

What is claimed is:

1. An iron type golf club head comprising a face surface including a toe inclination visually recognizing part and a heel inclination visually recognizing part, the toe inclination visually recognizing part provided on a toe side of the face surface, formed by a visible boundary between a toe side region of the face surface and a center region of the face surface, the heel inclination visually recognizing part provided on the heel side of the face surface, formed by a visible boundary between a heel side region of the face surface and the center region of the face surface, wherein, with the club head supported on a level surface and disposed at its designed lie angle and real loft angle;

the toe inclination visually recognizing part is inclined to the heel side from the toe side in a direction toward a sole side from a top side;

the heel inclination visually recognizing part is inclined to the heel side from the toe side in a direction toward the sole side from the top side;

the inclination of the toe inclination visually recognizing part to the heel side from the toe side in a direction toward the sole side from the top side is discernible when viewed vertically downwardly along a vertical plane that includes the axis of a shaft hole of the club head from a vantage point directly above the center region of the face surface;

the inclination of the heel inclination visually recognizing part to the heel side from the toe side in a direction toward the sole side from the top side is discernible when viewed vertically downwardly along a vertical plane that includes the axis of the shaft hole from a vantage point directly above the center region of the face surface;

an inclination angle α1 of the toe inclination visually recognizing part with respect to a vertical direction reference line is no less than 5 degrees and no more than 15 degrees, wherein the vertical reference line is parallel to a line formed by the intersection of the club face with a vertical plane that includes a line perpendicular to the club face and extending through the centroid of the club head;

an inclination angle α2 of the heel inclination visually recognizing part with respect to the vertical direction reference line is no less than 5 degrees and no more than 15 degrees; and the real loft angle B is no less than 50 degrees and no more than 70 degrees.

2. The iron type golf club head according to claim 1, wherein;

a face line is provided on the face surface;

the face line is inclined to the top side from the sole side in a direction toward the heel side from the toe side; and an inclination angle β of the face line with respect to a horizontal direction reference line is no less than 5 degrees and no more than 15 degrees, wherein the horizontal direction reference line is formed by the intersection of the club face with a horizontal plane.

3. The iron type golf club head according to claim 2, wherein a ratio (B/β) of the real loft angle B to the inclination angle β is no less than 5 and no more than 10.

4. The iron type golf club head according to claim 2, wherein;

a plurality of face lines is provided on the face surface;

a plurality of longest face lines of the face lines exists;

the toe inclination visually recognizing part is formed by arrangement of the toe side ends of the plurality of longest face lines; and the heel inclination visually recognizing part is formed by arrangement of the heel side ends of the plurality of longest face lines.

5. The iron type golf club head according to claim 1, wherein;

a plurality of face lines is provided on the face surface;

a plurality of longest face lines of the face lines exists;

the toe inclination visually recognizing part is formed by arrangement of the toe side ends of the plurality of longest face lines; and the heel inclination visually recognizing part is formed by arrangement of the heel side ends of the plurality of longest face lines.

6. The iron type golf club head according to claim 1, wherein;

the toe inclination recognizing part is formed by a difference between a surface treatment of the center region and a surface treatment of the toe side region; and the heel inclination recognizing part is formed by a difference between a surface treatment of the center region and a surface treatment of the heel side region.

* * * * *